US009250586B2

(12) United States Patent
Endo

(10) Patent No.: US 9,250,586 B2
(45) Date of Patent: Feb. 2, 2016

(54) ROLLER FOR FIXING, MANUFACTURING METHOD THEREFOR, AND FIXING DEVICE

(71) Applicant: CANON KABUSHIKI KAISHA, Tokyo (JP)

(72) Inventor: Michiaki Endo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/323,221

(22) Filed: Jul. 3, 2014

(65) Prior Publication Data

US 2015/0016854 A1 Jan. 15, 2015

(30) Foreign Application Priority Data

Jul. 12, 2013 (JP) ..... 2013-145951

(51) Int. Cl.
*G03G 15/20* (2006.01)

(52) U.S. Cl.
CPC ..... *G03G 15/206* (2013.01); *G03G 2215/2035* (2013.01); *G03G 2215/2067* (2013.01); *Y10T 29/49547* (2015.01)

(58) Field of Classification Search
CPC ..... G03G 15/2057; G03G 15/2053; G03G 15/206
USPC ..... 399/333
See application file for complete search history.

(56) References Cited

U.S. PATENT DOCUMENTS

| | | | | |
|---|---|---|---|---|
| 2,393,564 | A * | 1/1946 | Poupitch | 411/504 |
| 7,480,480 | B2 | 1/2009 | Endo et al. | |
| 7,505,725 | B2 | 3/2009 | Katayama et al. | |
| 7,546,078 | B2 | 6/2009 | Okuda et al. | |
| 2003/0226249 | A1 * | 12/2003 | Schnabel et al. | 29/525.06 |
| 2006/0021534 | A1 * | 2/2006 | Beaudry | B41F 13/18 101/389.1 |
| 2007/0081837 | A1 * | 4/2007 | Lee | 399/328 |
| 2008/0304874 | A1 * | 12/2008 | Takagi et al. | 399/286 |
| 2013/0121712 | A1 * | 5/2013 | Kaji | 399/44 |
| 2014/0161502 | A1 | 6/2014 | Endo | |

FOREIGN PATENT DOCUMENTS

JP 3-126970 A 5/1991

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A roller for image fixing, includes: a hollow cylindrical member; a shaft member inserted into one longitudinal end of the cylindrical member; a hole portion penetrating the cylindrical member and the shaft member; a first countersink formed at a circumference of one end of the hole portion in an outerside of the cylindrical member; a second countersink formed at a circumference of the other end of the hole portion in an outerside of the cylindrical member; and a pin inserted in the hole portion to fix the cylindrical member and the shaft member relative to each other. The one and the other end portions of the pin are deformed so as to be closely contacted to the first and second countersink portions, respectively.

18 Claims, 8 Drawing Sheets

(a)

(b)

ROLLER FOR FIXING, MANUFACTURING METHOD THEREFOR, AND FIXING DEVICE

FIELD OF THE INVENTION AND RELATED ART

The present invention relates to a roller usable for fixing an unfixed toner image on a sheet, a manufacturing method therefor, and a fixing device including the fixing roller.

In an image forming apparatus employing an electrophotographic process or the like, such as a copying machine, a printer or a complex machine thereof, the fixing roller for a fixing device for fixing a toner image on the recording material (sheet) is desired to be light in weight and low in cost. From such a point of view, a hollow pipe material (cylindrical member) becomes widely used for the fixing roller.

Japanese Laid-open Patent Application Hei 3-126970 proposes a heating roller of a hollow pipe material. The heating roller comprises a roller body of the hollow pipe material, and a hollow shaft member (flange) which is clamped relative to the inner surface of the roller body.

However, the clamping is not enough to assure a satisfactory connection strength.

Therefore, it is preferable to securely fix them by press-fitting a pin into a hole portion penetrating the pipe material and the shaft member. By doing so, the fixing therebetween can be maintained for long term.

The present invention provides a further development.

SUMMARY OF THE INVENTION

According to an aspect of the present invention, there is provided a roller for image fixing, comprising a hollow cylindrical member; a shaft member inserted into one longitudinal end of said cylindrical member; a hole portion penetrating said cylindrical member and said shaft member; a first countersink formed at a circumference of one end of said hole portion in an outerside of said cylindrical member; a second countersink formed at a circumference of the other end of said hole portion in an outerside of said cylindrical member; and a pin inserted in said hole portion to fix said cylindrical member and said shaft member relative to each other, wherein said one and the other end portions of said pin are deformed so as to be closely contacted to said first and second countersink portions, respectively.

According to another aspect of the present invention, there is provided a manufacturing method for a roller for image fixing, said method comprising steps of inserting a shaft member into a one longitudinal end of a hollow cylindrical member; forming a hole portion penetrating said cylindrical member and said shaft member; forming a first countersink at a circumference of one end of said hole portion in an outerside of said cylindrical member; forming a second countersink at a circumference of the other end of said hole portion in an outerside of said cylindrical member; inserting a pin into said hole portion; and deforming opposite end portions of said pin so as to closely contact to said first and second countersink portions, respectively.

According to a further aspect of the present invention, there is provided a fixing device comprising a roller usable for fixing an unfixed toner image on a sheet, said roller including a hollow cylindrical member, a shaft member inserted into one longitudinal end of said cylindrical member, a hole portion penetrating said cylindrical member and said shaft member, a first countersink formed at a circumference of one end of said hole portion in an outerside of said cylindrical member, a second countersink formed at a circumference of the other end of said hole portion in an outerside of said cylindrical member, and a pin inserted in said hole portion to fix said cylindrical member and said shaft member relative to each other, wherein said one and the other end portions of said pin are deformed so as to be closely contacted to said first and second countersink portions, respectively.

Further features of the present invention will become apparent from the following description of exemplary embodiments with reference to the attached drawings. These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described. The present invention is not limited to the specific embodiments which will be described below.

Embodiment 1

(1) Image Forming Station

Figure 3:
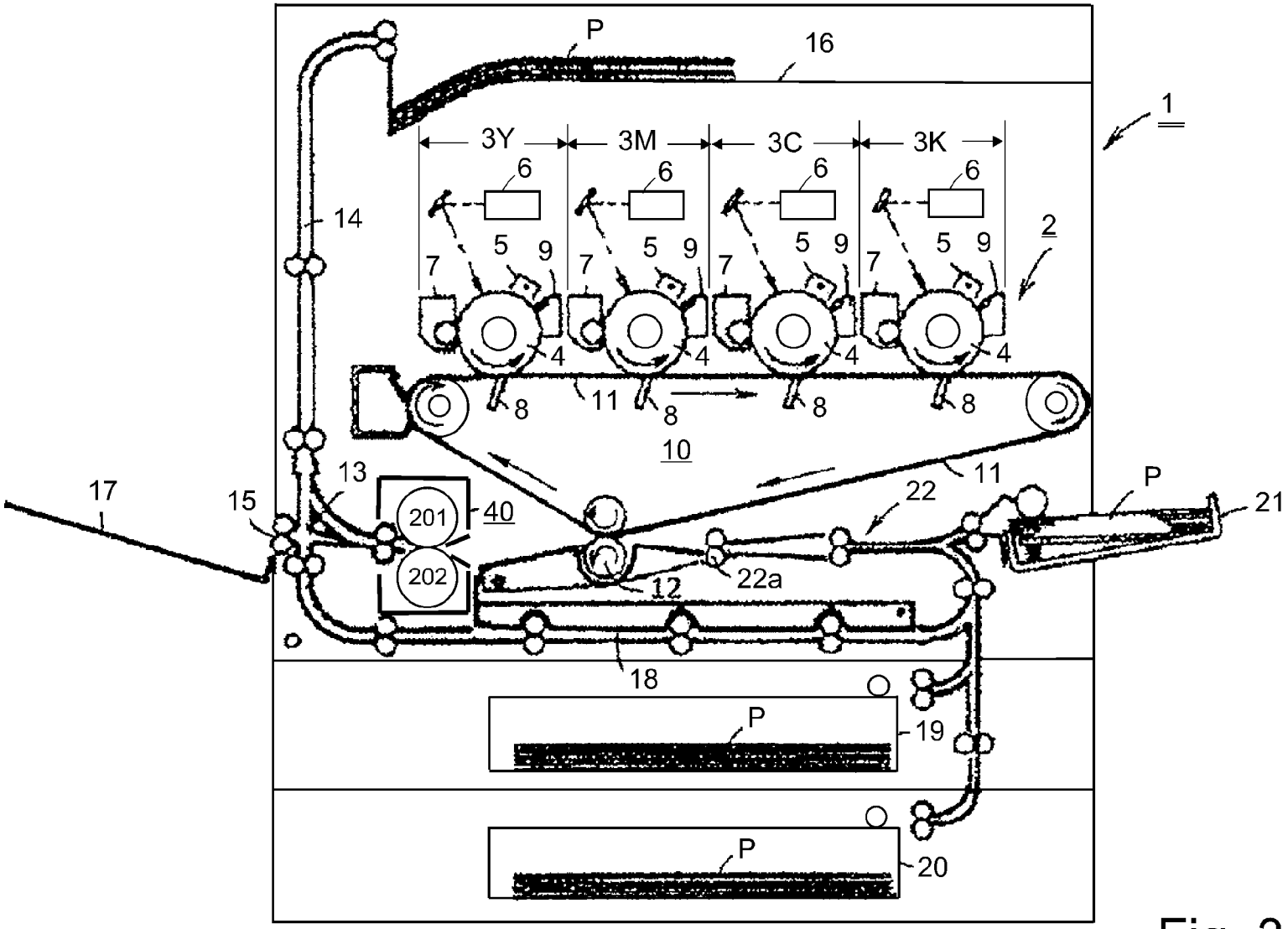
FIG. 3 shows a general arrangement of an image forming apparatus.

FIG. 3 shows a general arrangement of an example of an image forming apparatus 1 including an image fixing device (fixing device) 40 using the fixing roller of the present invention for a pressing roller 202. The image forming apparatus 1 is a color printer capable of forming, on a sheet-like recording material (transfer material, sheet) P, a toner image corresponding to image information supplied from a host apparatus 50 (FIG. 1) to a controller (control circuit portion) 45, using an electrophotographic technique. The sheet P on which the toner image is formed is plain paper having a basis weight of 60-105 g/m^2, thick sheet having a basis weight exceeding 106 g/m^2, a resin material sheet or the like.

Designated by 2 is image forming stations including four image forming stations 3Y, 3M, 3C, 3K for forming an image on the sheet P. The sheet P is fed out of a sheet feeding cassette 19 or 20 or out of a manual insertion tray (multi-sheet feeding tray) 21 and is further fed by a feeding mechanism 22 including a registration roller pair 22*a*.

Each image forming station includes a rotatable drum type photosensitive member 4 as an image bearing member, a charging member 5, a laser scanner 6, a developing device 7, a transfer member 8 and a photosensitive member cleaner 9.

Image forming stations 3Y, 3M, 3C, 3K form toner images of yellow color, magenta color, cyan color and black color, respectively.

The image forming station 2 includes an intermediary transfer unit 10 which has a secondary transfer roller 12 secondary-transferring the toner images primary-transferred toner images onto the intermediary transfer belt 11 from the image forming stations 3Y, 3M, 3C, 3K, onto the sheet P all together. The operations of the image forming station 2 and the color image forming process are well-known, and therefore, detailed description thereof are omitted for simplicity.

The sheet P now carrying the secondary-transferred toner images (unfixed) is fed to the fixing device 40, where the toner image is fixed into a fixed image. The sheet P discharged from the fixing device 40 is fed to a first path 14 or a second path 15 by a flapper 13 in accordance with a pre-set mode selection. The sheet P introduced to the first path 14 is discharged to a face down tray 16 provided at a top side of the apparatus. The sheet the introduced to the second path 15 is discharged to a face up tray 17 provided at a side of the apparatus.

In a both sided-image forming mode, the sheet P having a first surface image formation is introduced in the first path 14 temporarily and is then switched back into a third path 18. And, it is refed by the feeding mechanism 22 into the image forming station 2 in a backside up state.

Figure 1:
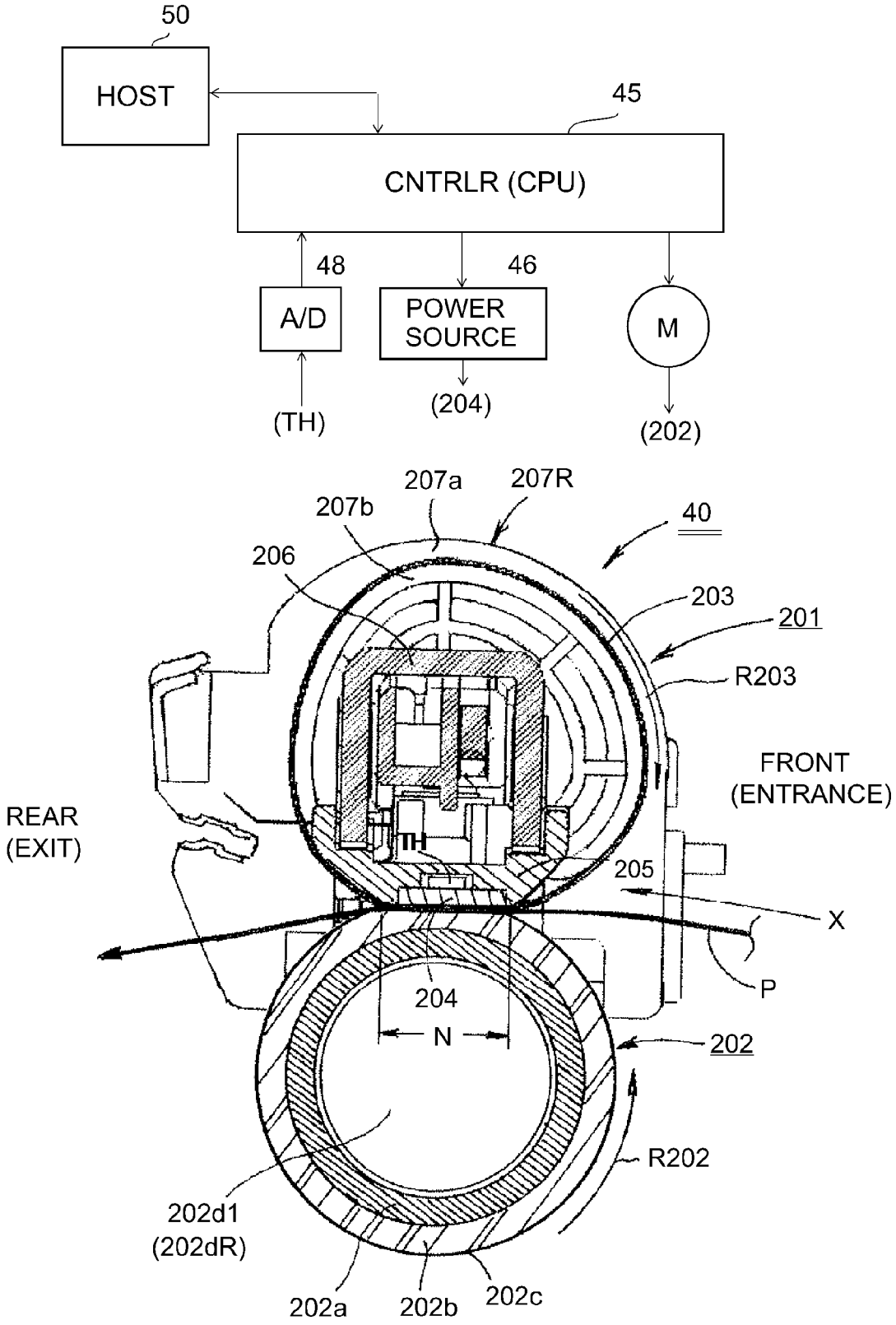
FIG. 1 is an enlarged right cross-section of a major part of a fixing device, and a block diagram of a control system, according to Embodiment 1 of the present invention.
Figure 2:
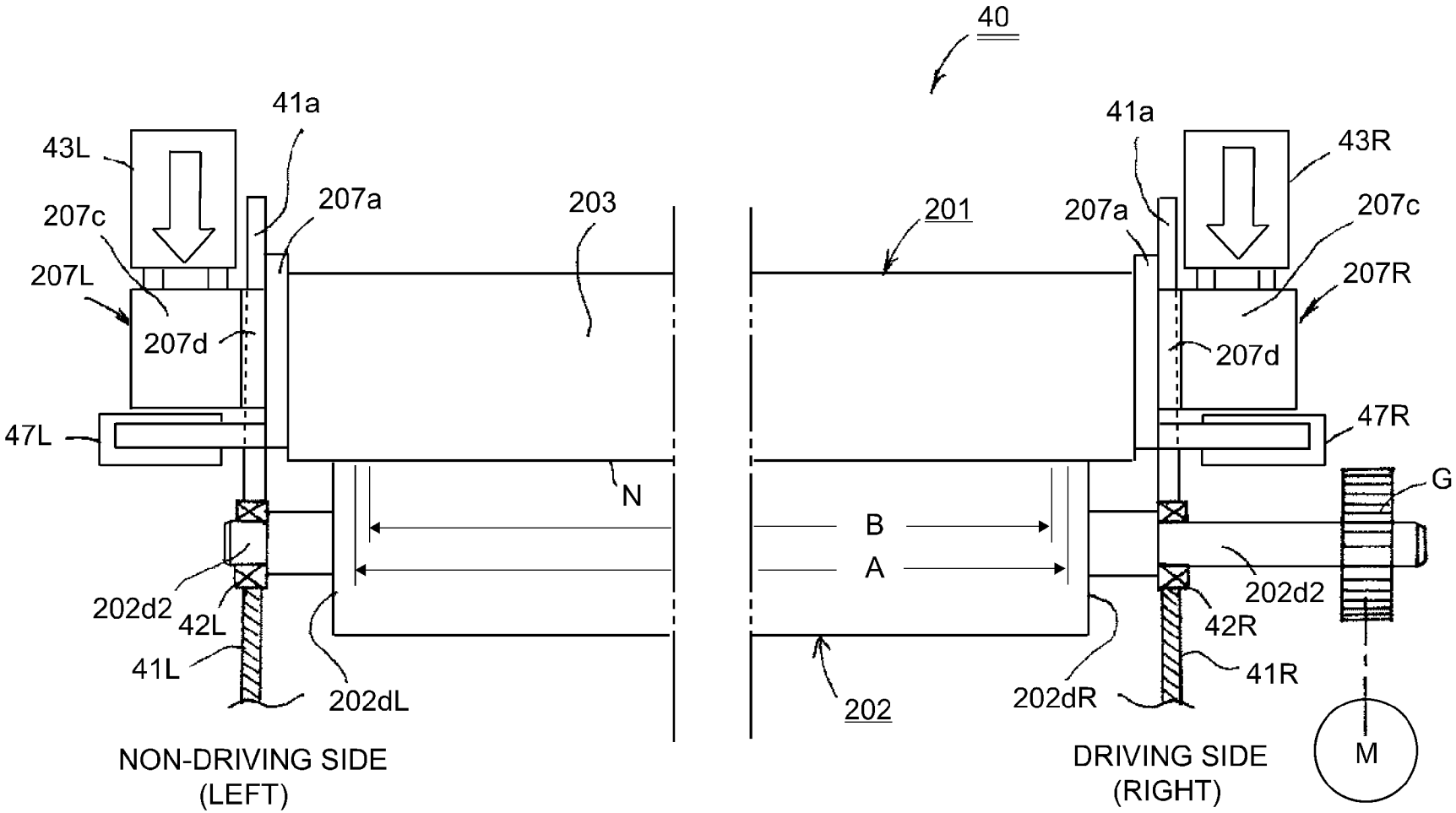
FIG. 2 is a partly omitted substantial front view of a major part of the fixing device.

(2) Fixing Device (2-1) General Arrangement of the Fixing Device:

FIG. 1 is an enlarged right-side cross section of a major part of the fixing device 40 of this embodiment, and a block diagram of a control system. FIG. 2 is a partly omitted substantial front view of a major part of the fixing device.

Here, in the fixing device 40 and the structural members of this embodiment, a front side is a sheet entrance side of the fixing device 40, and a rear side is a sheet exit side (opposite from the entrance side). And, left and right are left-hand (one end portion side) and right-hand (other end portion side) as seen from the front side. In the fixing device 40 of this embodiment, the right side is a driving side, and the left side is a non-driving side.

An upstream side and a downstream side are based on a feeding direction X of the sheet. A longitudinal direction (widthwise direction) and a sheet widthwise direction are a direction substantially parallel with a direction perpendicular to the feeding direction X of the sheet P in a sheet feeding path plane. A shortwise direction is a direction substantially parallel with the feeding direction X of the sheet P in a sheet feeding path plane.

The fixing device 40 of this embodiment is an on-demand fixing device of an endless film (belt) heating type, and is elongated in a direction parallel with the direction perpendicular to the feeding direction X of the sheet P within a sheet feeding path plane. The fixing device 40 generally comprises a film unit 201 as a heating member and a pressing roller (second rotatable member) 202 as a pressing member.

The film unit 201 is an assembly of a fixing film 203, a heater (heating element) 204, a heater holder 205, a pressing stay 206, left and right end members (fixing flanges) 207 (L, R) and so on.

The fixing film 203 is a rotatable heating member (thin rotatable member, endless belt, or film) of flexible cylinder (cylindrical, endless) and is long in the left-right directions to apply heat to the sheet P. In this embodiment, the film 203 comprises a cylindrical base of flexible and heat resistive polyamide-imide having an inner diameter of 30 mm and a thickness of 50 μm, and a coating of PFA on the outer periphery surface. The PFA is a copolymer resin material of tetrafluoroethylene and parfluoroalkoxyethylene. The film 203 may be made of metal.

The heater 204, the heater holder 205 and the pressing stay 206 are elongated in the left-right direction. The film 203 is slightly loosely fitted around the assembly of the heater holder 205 holding the heater 204, the pressing stay 206 and the left and right end members 207, that is, the inner circumferential length of the film 203 is 102% the outer periphery length of the assembly.

The heater 204 is a ceramic heater in this embodiment. The heater 204 mainly comprises an elongated thin-plate-like ceramic substrate, and an electric heat generating resistor layer on the substrate, and it has a low thermal capacity with which the temperature rises steeply in response to electric power supply to the heat generating resistor layer. A back side of a longitudinally central portion of the heater 204 is provided with a thermister TH as a heater temperature detecting member.

The heater holder 205 is a molded product of heat resistive resin material, and is provided with a groove extending in the longitudinal direction at the central portion of the outer surface. The heater 204 is fitted in the groove so that it is supported by the heater holder 205. The heater holder 205 supports the heater 204 and functions as rotation guiding member for the film 203 which is fitted around the heater holder 205 and the pressing stay 206.

The pressing stay 206 is a rigid member and is pressed against a back side of the heater holder 205 of resin material to provide a longitudinal strength of the heater holder 205 and is effective to rectify the heater holder 205. In this embodiment, the pressing stay 206 is a metal mold having a U cross-section opening downward.

The left and right end members 207 are mounted to the left-right side end portions of the pressing stay 206, respectively, at the left and right end portions of the assembly comprising the heater 204, the heater holder 205, the pressing stay 206 and the film 203. The end members 207 function to regulate movement of the film 203 along the longitudinal direction of the heater holder during rotation of the film 203 and to guide the inner surface of the end portion of the film, thus regulating the circumferential shape of the film.

Each of the symmetrical left and right end members 207 is a molded product of a heat resistive resin material property and is provided with a flange seat portion 207*a* (first regulating portion) for stopping film end edge to regulate movement of the film 203 in the longitudinal direction. In addition, it is provided with an inner surface guide portion 207*b* (second regulating portion) for guiding the inner surface at the end portion of the rotating film 203. As will be described hereinafter, when the film 203 is rotated by the pressing roller 202 as the driving rotatable member, the cross-sectional configuration of the film 203 is substantially elliptical, and the inner surface guide portion 207*b* guides the inner surface of the film end portion so as to maintain the elliptical configuration.

The pressing roller 202 as a roller usable for fixing is a multi-layer roller comprises a core metal (roller base) 202*a* which is a hollow cylindrical member, an elastic layer (rubber layer) 202*b* coating the core metal concentrically and integrally, and a toner parting layer (surface layer) 202*c* coating the outer peripheral surface, and has an outer diameter of 30 mm. The core metal 202*a* a pipe material of mild steel having a circular cross-section. The elastic material layer 202*b* is made of silicone rubber. The parting layer 202*c* is made of PFA. Each of the opposite end portions of the core metal 202*a* is provided with a flange 202*d* (L, R) having a rotation center shaft portion 202*d*2. Mounting structure of the flange 202*d* relative to the core metal 202*a* and a manufacturing method of the roller 202 will be described hereinafter.

A shaft portions 202*d*2 (left and right shaft members) of the flange 202*d* of the pressing roller 202 are rotatably supported by bearing members of the left and right side plates 41 (L, R) of the fixing device frame (frame). The shaft portion 202*d*2 of the right side (driving side) flange 202*d*R is provided with a drive gear G concentrically and integrally. A driving force is transmitted to the gear G from the driving means (motor) M controlled by a controller 45 through a power transmission mechanism (unshown). By this, the pressing roller 202 is rotated at a predetermined peripheral speed in a counterclockwise direction indicated by an arrow R202 in FIG. 1.

On the other hand, the film unit 201 is provided above the pressing roller 202 with the heater disposition portion side of the heater holder 205 facing down, substantially in parallel with the pressing roller 202, between the left and right side plates 41 of the fixing device frame. More particularly, vertical guide groove portions 207*d* of the left and right end members 207 of the film unit 201 are engaged with vertical edges of the vertical guide slits 41*a* provided in the left and right side plates 41" respectively.

By this, the left and right end members 207 are supported slidably in the vertical direction relative to the left and right side plate 41, respectively. That is, the film unit 201 is supported slidably in the vertical direction relative to the left and right side plates 41. The heater of the heater holder 205 of the film unit 201 is opposed to the pressing roller 202 the film 203.

Pressure receiving portions portion 207*c* of the left and right end members 207 are pressed by left and right pressing mechanisms 43 (L, R) with a predetermined urging force, respectively. That is, the film unit 201 is pressed to the pressing roller 202 at a predetermined urging force. By this, the heater of the heater holder 205 and the pressing roller 202 are urged toward each other sandwiching the film 203. The left and right pressing mechanisms 43 include urging springs, pressing cams or the like, for example.

In this embodiment, the left and right pressing mechanism 43 apply loads of 157 N (16 Kg) to the left and right end member 207, respectively to press the film unit 201 to the pressing roller 202 with an overall press-contact force of 314 N (32 Kg). By this, a nip N of a predetermined width (sheet feeding direction X) is formed between the film 203 and the pressing roller 202. The heater 204 extends in the longitudinal direction of the heater holder at the position corresponding to the nip N of the heater holder 205.

In the fixing device 40 of this embodiment, the heater 204 and the heater holder 205 are a nip forming member contacting the inner surface of the film 203. The pressing roller 202 cooperates with the nip forming members 204, 205 to form the nip N the film 203.

It is desired that a pressure distribution in the nip N is uniform along the longitudinal direction. Because of the points of the weight to the film unit 101 and the support points of the pressing roller 202, and the flexure of the pressing stay 205, the pressure in the longitudinally central portion of the nip N tends to be lower than the pressures in the opposite end portions. To prevent this, the diameter of the central portion of the pressing roller 202 is slightly larger than those in the opposite end portions. That is, the outer diameter configuration of the pressing elastic roller 202 is crowned.

More specifically, the outer diameter of the pressing roller 202 in the longitudinally central portion (30 mm) is larger than those of the end portions by 200 microns. Therefore, the pressing roller 202 receives a uniform load distribution, and a moment in the direction of lowering the pressing roller 202 about the bearing portions 42L, 42R which are support points of the pressing roller 202.

(2-2) Fixing Operation:

The fixing operation of the fixing device 40 is as follows. The controller 45 actuates a driving means M at predetermined control timing. A rotational force is transmitted from the driving means M to the pressing roller 202 *a* rotational drive transmission system (unshown). By this, the pressing roller 202 is rotated in the counterclockwise direction indicated by an arrow R202 at a predetermined speed.

By the rotation of the pressing roller 202, due to the frictional force between the pressing roller 202 and the film 203, a rotational torque is applied to the film 203 in the nip N. By this, the film 203 is rotated in the clockwise direction indicated by an arrow R203 at the speed substantially corresponding to the speed of the pressing roller 202 around the heater holder 205 and the pressing stay 206, while the inner surface thereof is in close-contact with the surface of the heater 204. To the inner surface of the film 203, a semi-solid lubricant is applied to assure a slidability between the inner surface of the film 203 and the outer surfaces of the heater 204 and the heater holder 205 in the nip N.

In this manner, the pressing roller 202 is a driving rotatable member which cooperates with a film 203 for driving the film 203 to form the nip N.

The controller 45 starts electric power supply to the heater 204 from the electric power supply portion (voltage source portion) 46. The electric power supply from the electric power supply portion 46 to the heater 204 is accomplished through electrical connectors 47 (L, R) mounted to the left and right portions of the film unit 201. By electric power supply, the temperature of the heater 204 in the effective heat generating region width A rapidly rises. The temperature rise is detected by a thermister TH provided on the back side (upper surface) of the heater 204 at the substantially central portion in the longitudinal direction. The thermister TH is connected to the controller 45 an A/D converter 48.

The controller 45 samples out the output of the thermister TH, and the temperature information thus acquired is used for temperature control. More particularly, the controller 45 determines a content of the temperature control for the heater 204 on the basis of the output of the thermister TH, and controls the electric power supply to the heater 204 so that the temperature of the heater 204 is maintained at a target temperature (set temperature).

Into the fixing device 40 under such a control, more particularly into the nip N, a sheet P carrying an unfixed toner image is introduced from the image forming station 2. While the sheet P is nipped and fed in the nip N, the heat is supplied from the heater 204 through the film 203. The unfixed toner image is fixed on the surface of the sheet P by the heat from the heater 204 and the pressure by the nip N, into a fixed image. The sheet P discharged from the nip N is separated from the film 203 using a reduced curvature and then is discharged from the fixing device 40.

When the sheet P enters the nip N, the film 203 encounters a sliding resistance due to the sliding on the heater 203. The pressing roller 202 feeds the sheet P against the sliding resistance. A load torque at the pressing roller shaft portion is 80 Ncm in this embodiment. Upon the completion of the printing operation, the controller 40 shut off the electric energy supply to the heater 204 from the voltage supply portion 46 and stops the driving means M, in response to the completion of the fixing operation.

In FIG. 2, designated by B is the maximum feeding width of the sheet P usable with the device 40 and is the same as or a little smaller than the effective heat generating region width A of the heater 204. The total length of the nip N is larger than the effective heat generating region width A of the heater 204.

Figure 4:
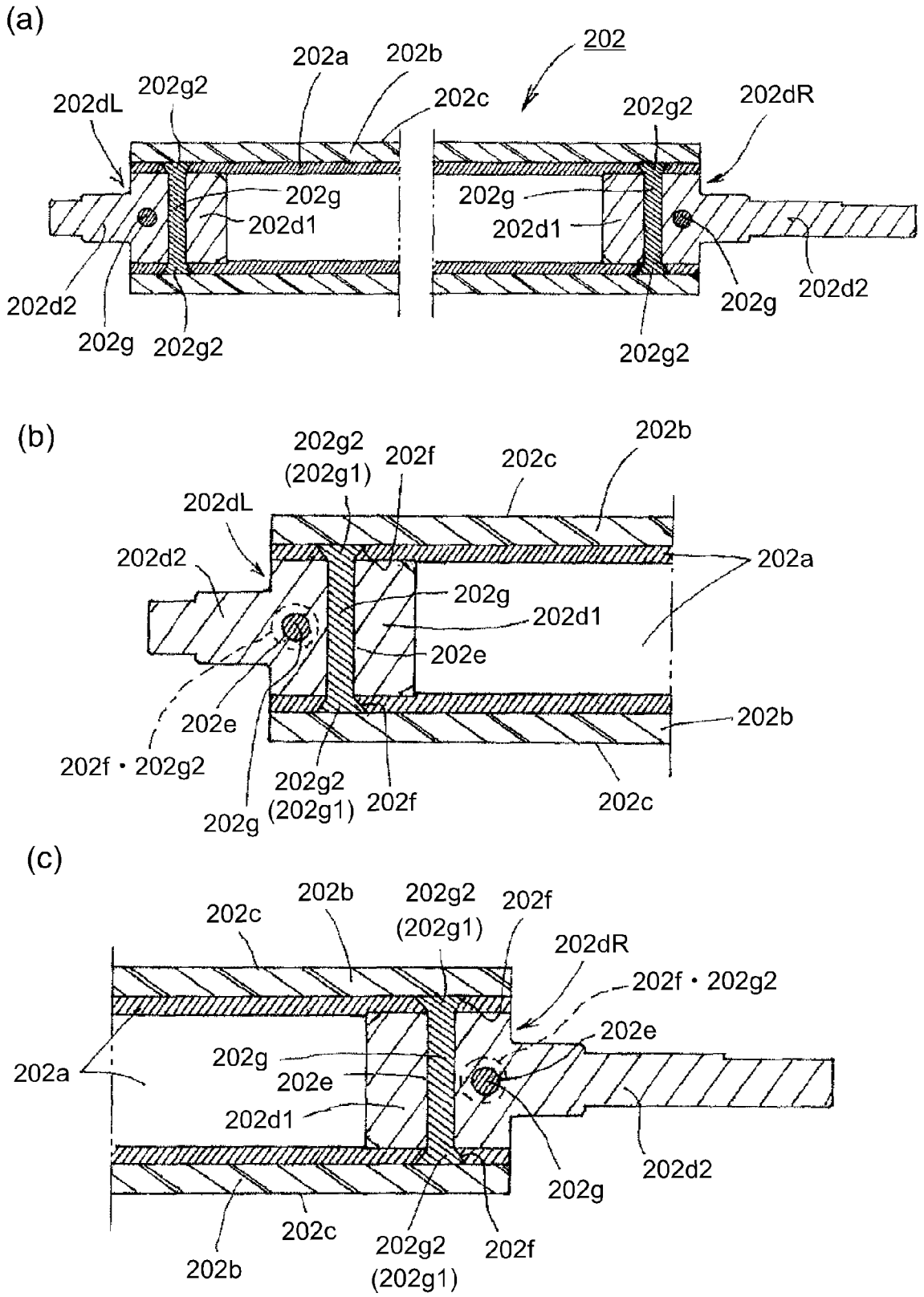
FIG. 4 is an illustration of a structure of a pressing roller.

(2-3) Structure of Pressing Roller:

Part (a) of FIG. 4 is a partly omitted schematic longitudinal front view of the pressing roller 202 as the roller for image fixing, and (b) when (c) are enlarged views of the left-hand end portion and in the right-hand end portion of the roller 202 shown in (a).

Figure 7:
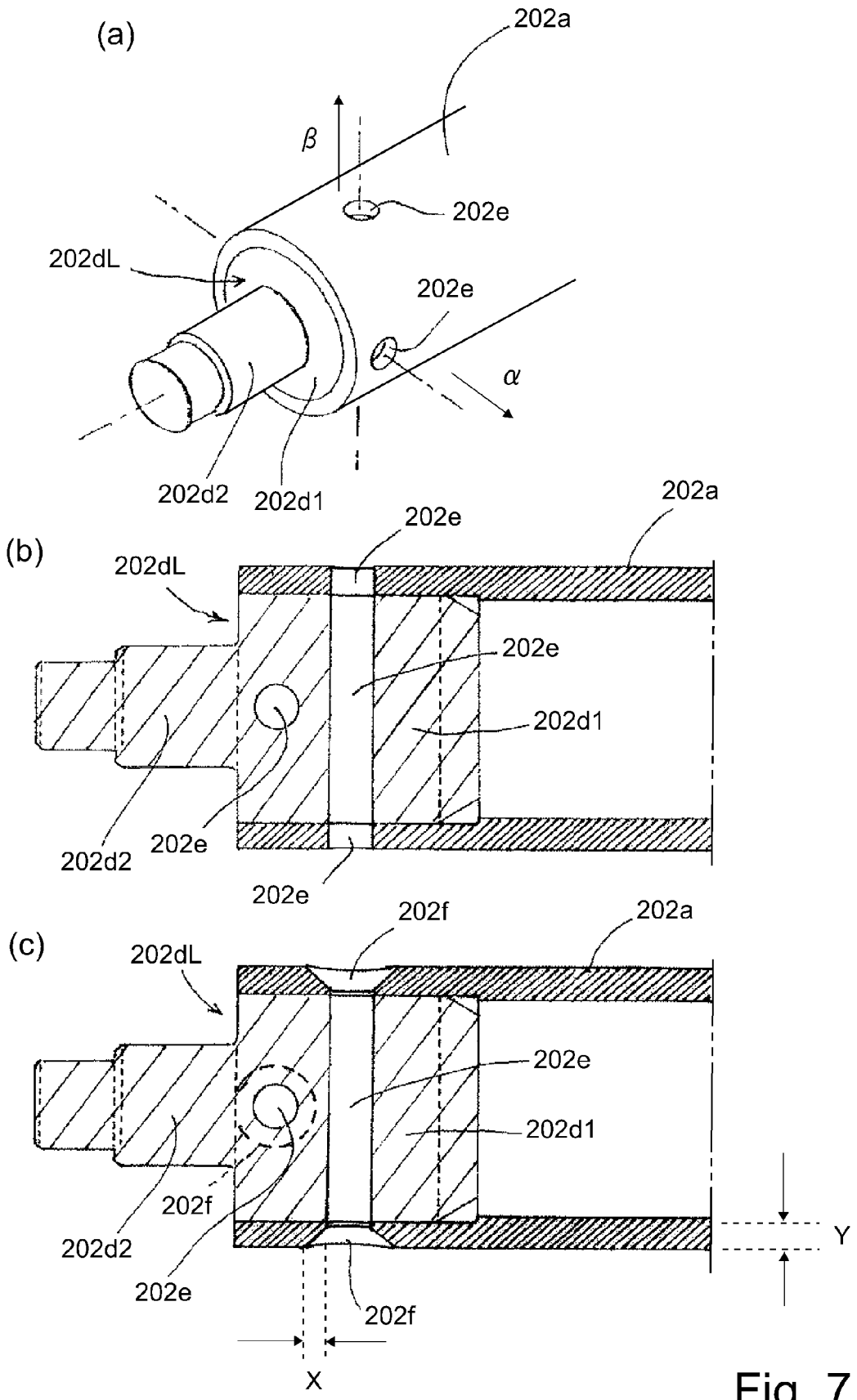
FIG. 7 is an illustration of formation of an insertion hole and a countersink configuration.

The pressing roller 202 comprises a pipe material 202*a* having a circular cross-section as a roller base (core metal) which is a hollow cylindrical member, and flanges 202*d* (L, R) which are left side and right side shaft members contacted with the left and right end portions of the pipe material 202*a*, respectively. In addition, it is provided with countersinks (C shape cross-section countersinks, or C-chamfers under JIS B 0701, in the cross-section) 202*f*, at the openings of the pipe material, a hole 202*e* and a hole 202*e* for the pin penetrating the pipe material 202*a* and the flange 202*d*. It is further provided with a pin 202 *g* penetrated through the hole 202*e* and having end portions 202*g*1 which are closely contacted to the C-countersinks 202*f* by plastic deformation (202*g*2). The chamfer line in the cross-section may be straight (conical countersink) or may be curved (concave countersink), but 90 degrees counterboring is less preferable. As shown in FIG. 7, the countersink has a cross-section in which X=Y.

With this structure, the left and right flanges 202*d* are mounted to the left and right end portions of the pipe material 202*a*. In this embodiment, the roller four image fixing is an elastic pressing roller 202, and therefore, an elastic layer as another member (rubber) 202*b* are fitted around the outer peripheral surface of the pipe material 202*a* to which the flanges 202*d* are mounted at the left and right end portions, respectively. In addition, a toner parting layer 202*c* coats the outer peripheral surface of the elastic layer. The elastic layer 202*b* is crowned to a predetermined degree.

Here, the outer diameter of the pipe material 202*a* may be crowned by machining. Or, both of the pipe material 202*a* and the elastic material layer 202*b* may be crowned, depending on the types of the fixing device.

The mounting structures of the left and right flanges 202*d* to the left and right end portions of the pipe material 202*a* are similar to each other. In the following, the description will be made with respect to the mounting of the left side flange 202*d*L to the left side portion of the pipe material 202*a*.

Figure 5:
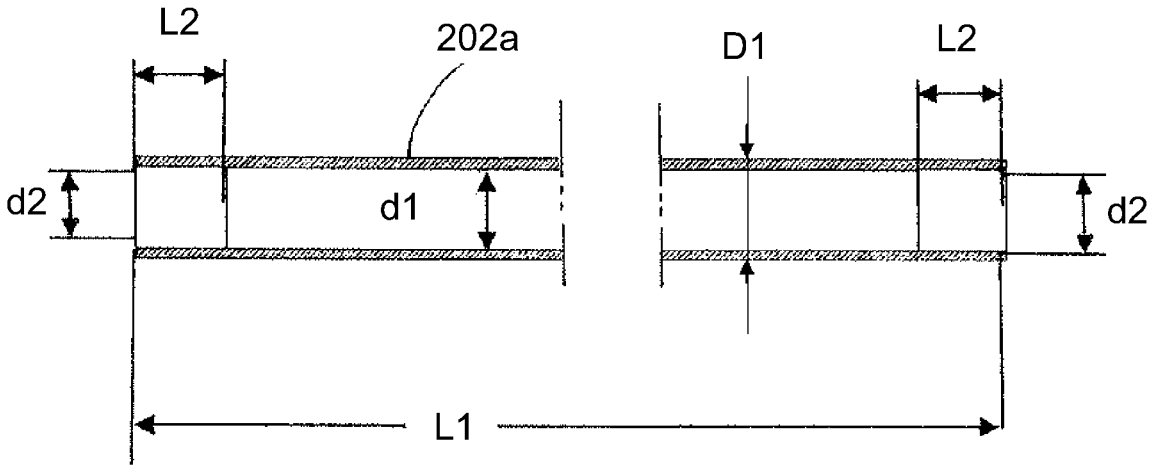
FIG. 5 is an illustration of a structure of a core metal (pipe material) of the pressing roller.
Figure 5:
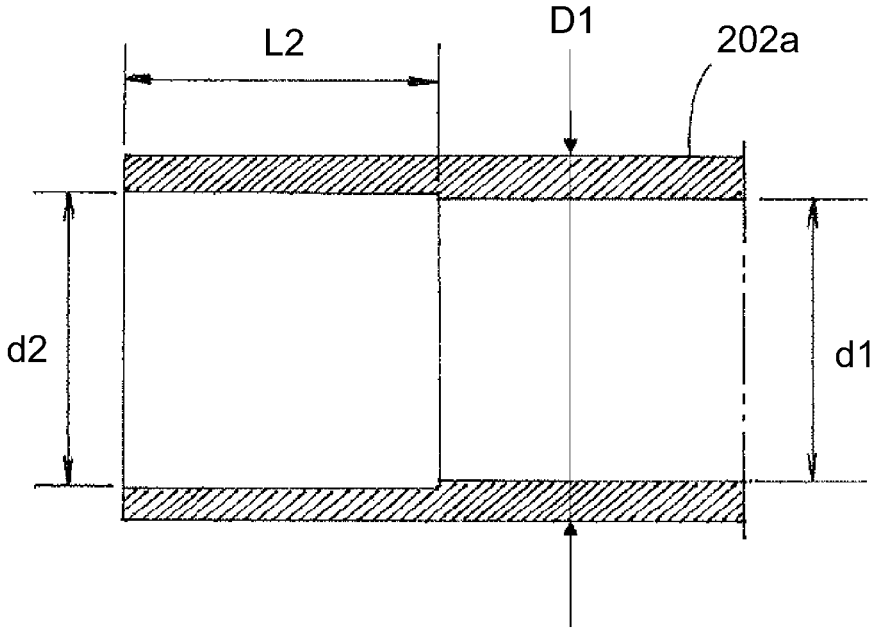

Part (a) of FIG. 5 is a partly omitted schematic longitudinal front view of the pipe material 202*a*, (b) is an enlarged view of a left-hand end portion of the pipe material 202*a* shown in (a). The pipe material 202*a* is made of STKM (carbon steel tube for machine structure) and has a total length L1 of 377 mm, an inner diameter d1 of 20 mm, and an outer diameter D1 of 25.5 mm. The inner diameter d2 is enlarged to 20.65 mm from the end of the pipe material to the depth L2 of 21.8 mm, at each of the opposite end portions.

Figure 6:
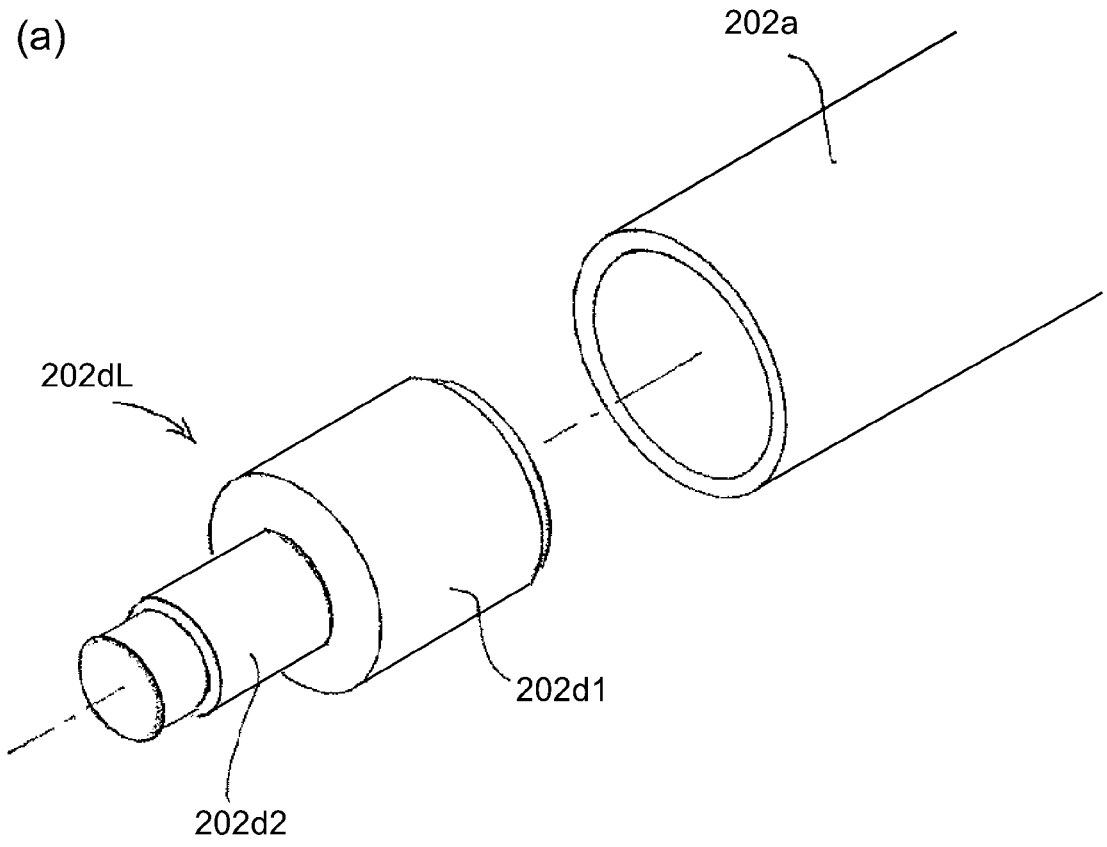
FIG. 6 is an illustration of a structure of a flange.
Figure 6:
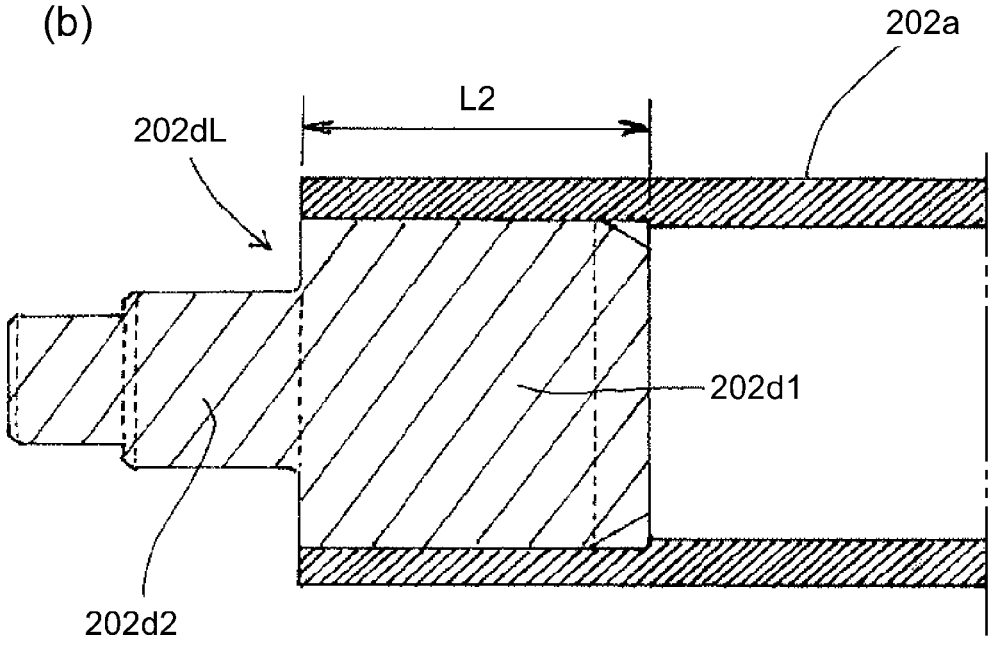

Part (a) of FIG. 6 is a perspective view of an outer appearance of the left side flange 202*d*L and the left-hand end portion of the pipe material 202*a*, (b) is a schematic longitudinal front view in which the left side flange 202*d*L is connected to the left-hand end portion of the pipe material 202*a*. The flange 202*d*L is made of S45C (carbon steel for machine structure) and includes a columnar inserting portion 202*d*1 press-fitted to the inside circumference (L2) of the end portion of the pipe material 202*a*, and a rotation center shaft portion 202*d*2 of the roller 202. In this embodiment, the materials of the pipe material 202*a* and the flange 202*d* are different. However, they may be the same.

The outer diameter of the inserting portion 202*d*1 is slightly larger than an inner diameter of the end portion inside circumference of the pipe material 202*a* so that the inserting portion 202*d*1 of the flange 202*d*L is press fitted to the end portion inside circumference of the pipe material 202*a*.

As shown in part (b) of FIG. 6, the inserting portion 202*d*1 of the flange 202*d*L it is press fitted into the pipe material 202*a* to connect it to the end portion of the pipe material 202*a*. Similarly, the right side flange 202*d*R is connected to the right side end portion of the pipe material 202*a*. The right side flange 202*d*R has an inserting portion 202*d*1 similar to the flange 202*d*L, although the rotation center shaft portion 202*d*2 is longer than that of the left side flange 202*d*L by a predetermined length. Similarly to the left side flange 202*d*L, it is press-fitted into the right side end portion of the pipe material 202*a*. In this manner, the flanges 202*d* are contacted to the respective end portions of the pipe material 202*a*.

The connection between the pipe material 202*a* and the flange 202*d*L is as follows ((1)-(4)).

(1) As shown in parts (a) when (b) of FIG. 7, a straight hole 202*e* for pin is drilled through the pipe material 202*a* and the flange 202*d*L. In this embodiment, two holes 202*e* are drilled at positions different from each other in the longitudinal direction of the pipe material so that the holes extend in the orthogonal directions (α direction and β direction in (a) of FIG. 7). The hole diameters are 4 mm. Similarly, at the connecting portion between the pipe material 202*a* and the right side flange 202*d*R, similar holes 202*e* are drilled. In this manner, the pin insertion holes 202*e* are drilled through the pipe material 202*a* and the flange 202*d*.

(2) then, as shown in part (c) of FIG. 7, C—countersink 202*f* is formed around the edge of the hole 202*e* of the pipe material at each of the outside ends of the hole 202*e* of the pipe material. The C—countersink is formed at four positions of the two holes 202*e*.

The C—countersink is machined by drilling, and the size thereof is C1 as stated in (JIS B 0701). More particularly, in FIG. 7, X=Y=1 mm. The same applies to the holes 202*e* in the right-hand end portion of the pipe 202*a*, that is, countersink 202*f* is formed at each position. In this manner, the countersinks 202*f* are formed at the opening edges of the holes 202*e*.

Figure 8:
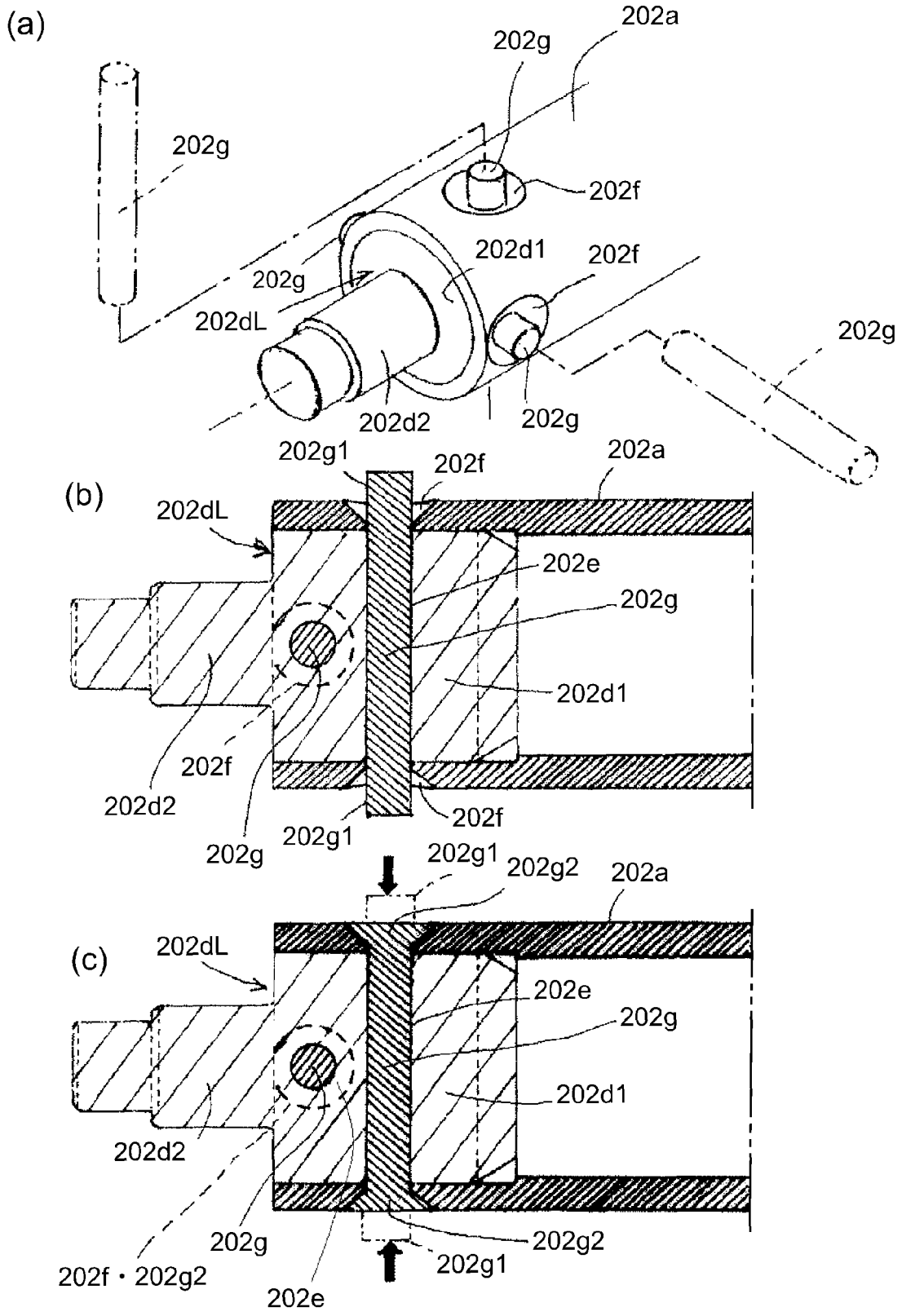
FIG. 8 is an illustration of a pin insertion into an insertion hole and a plastic deformation process of an end portion of a pin.

(3) Then, as shown in parts (a) and (b) of FIG. 8, a pin 202 *g* having a predetermined length is inserted through the hole 202*e* by light press-fitting. The material of the pin 202 *g* is A6063 (aluminum alloy) and has an outer diameter of 4 mm. The length thereof is long enough to be able to occupy the volume of the space of the countersink portion 202*f*. Similarly, the pin 202 *g* is penetrated through each of the holes 202*e* at the right-hand end portion of the pipe 202*a*. In this manner, the pins 202 *g* are penetrated through the respective holes 202*e*.

(4) then, as shown in parts (b) and (c) of FIG. 8, the opposite end portions 202*g*1 of each pin 202 *g* are crushed (permanent deformation) as indicated by arrows in part (c) of FIG. 8 using tools, so that the crushed parts are closely contacted to the surfaces of the countersinks into flush with the outer peripheral surface of the pipe material 202*a*. Similarly, with respect to each pin 202 *g* in the right-hand end portion of the pipe 202*a*, the end portions are crushed into close contact to the countersinks and into flush with the outer peripheral surface of the pipe material 202*a*. In this manner, the end portions of the pins 202 *g* are permanently deformed to fill the spaces provided by the countersinks. After the crush of the pin end portions, the pins 202 *g* are not movable relative to the roller.

As described in the foregoing, each pin 202 *g* is subjected to the crush at the end portions into the shapes of the countersinks 202*f* and into flush with outer peripheral surface of the pipe material 202*a*. Therefore, the material hardness of the pin 202 *g* is desirably lower than the material hardnesses of the pipe material 202*a* and the flange 202*d*.

After the plastic deformation process of the end portions of the pins 202 *g*, an another member may be provided on the outer peripheral surface of the pipe material 202*a*, if necessary. In this embodiment, for the purpose of views as the elastic pressing roller shown in FIG. 4, an elastic layer (rubber layer) 202*b* and a surface layer (parting layer) 202*c* as another material are provided on the outer peripheral surface of the pipe material 202*a*. In this embodiment, the elastic layer 202*b* is crowned.

Because of the plastic deformation step for the end portions 202*g*1 of the pin 202 *g* as shown in parts (b) and (c) of FIG. 8, it can be avoided that the rubber coats the pipe material with the end portions of the pins protruding beyond the outer periphery of the pipe material and that insertion of the pin is inadvertently omitted.

By the provisions of the pins 202 *g* through the through-holes 202*e* of the pipe material 202*a* and the flange 202*d*, the configuration of the pressing roller 202 can be maintained against the force produced when the pressing roller 202 rotates the film 203. In addition, the configuration of the pressing roller 202 can be maintained against the force in the direction of pulling the flange 202*d* out of the pipe material 202*a* in the longitudinal direction applied in order to make even the pressure in the nip N along the longitudinal direction. Thus, the configuration of the pressing roller 202 can be maintained against such two kinds of forces.

(2-4) Others about the Roller for Image Fixing:

In the case that a pipe material is used for a roller in the fixing device, it is necessary to provide shaft portions at the opposite end portions because the material is hollow. If the shaft portions are not used, and the outer peripheral of the pipe material it supported by a bearing, the size of the portion required by the roller including the bearing in the fixing device is relatively large with the result of upsizing of the fixing device. In other to avoid this, a flange is inserted into and fixed to each of the opposite end portions of the pipe material, and the flange it supported by the bearing.

The pipe material and the flange material in the fixing device may be different in consideration of the difference in the function. For the pipe material, a processing property and a heat property are taken into account.

1. Processing Property:

In the case of the fixing device in which the pressing roller is press contacted to the endless fixing film, for example, the pressure distribution of the fixing nip provided by the fixing film and the pressing roller it desirably even along the longitudinal direction thereof. For this purpose, the outer peripheral surface of the pipe material of pressing roller is crowned. Therefore, the material having good machining property is desired.

2. Thermal Property:

Recently, reduction of stand-by time until the image forming apparatus becomes openable is desired from the standpoint of energy conservation. In order to accomplish this, it is preferable that the thermal capacity of the roller itself is reduced so that the time required until the temperature of the fixing device reaches a target temperature for the image forming operation. From this standpoint, a thickness of the roller is desirably reduced. In addition, a high heat transfer property material is desired.

On the other hand, the property desired for the flange is a high hardness and a high anti-wearing property because of the engagement with the bearing.

However, in the connection between the pipe material and the flange, the following is preferably taken into account.

A: because the pipe material is hollow, the connection area is not sufficient, and therefore, press-fitting strength is not enough.

B: because the thickness of the pipe material per se is small, and therefore, an upper limit of the press-fitting strength is low, and a sufficient press-fitting strength is not assured.

C: an operating temperature in the fixing device is as high as not less than 160 degree C., and therefore, when different kind materials are connected with each other, the connection strength is not high because of the difference in the thermal expansion coefficient.

In other to enhance the connection strength between the pipe material and the flange, a pin in the writings through both of the pipe material and the flange is used. By doing so, the strength can be enhanced both in the rotational moving direction and longitudinal direction.

If the pin insertion hole through the pipe material and the flange is straight, it may be easily removed from the pin insertion hole. Or, it may be mounted with offset from the predetermined position.

When it is used as a roller four image fixing, another material such as rubber is provided on the outer periphery of the pipe material. If the rubber coats the pipe material without insertion of the pin or with protruded pin, the problems with the pin are not seen. If the roller is assembled into the fixing device in such a state, and a recording material is processed, the pin may tear the rubber to damage another parts.

In this embodiment, to avoid such problems, the countersinks are provided for the pin insertion holes at the outer peripheral surface of the pipe material. When the pin end portion is deformed by tools, the pin end portion is deformed substantially into conformity with the shape of the countersink. In this manner, after the completion of the pressing roller core metal manufacturing, the pins prevent movement of the flange relative to the pipe material.

In this manner, when the thin hollow pipe material and the flange a used in combination for the roller in the fixing device of the image forming apparatus, the pin is inserted through both of the pipe and the flange, by which the connection strength in the rotational moving direction and in the pulling direction. Therefore, the material of the flange portion minute which requires the anti-wearing property and the material of the pipe portion minute which requires high thermal responsivity and high machining property can be selected individually.

By doing so, bearings having bearing races smaller than the outer diameter of the pipe material are usable, so that the fixing device can be downsized, and the machining amount in the pressing roller core metal manufacturing can be minimized.

Therefore, a light weight, low cost and high thermal responsivity pressing roller can be provided. In the case that the rubber or the like is provided on the outer periphery of the pipe material, no problem arises from positional deviation of the pins because of the above-described the countersinks of the holes and the plastic deformation of the pins.

[Others]

1) The use of the roller according to the present invention is not limited to the above-described elastic pressing roller 202. In a fixing device for fixing an image on a recording material by nipping and feeding the recording material by a nip forward between a first rotatable member and a second rotatable member, the role of the present invention is usable for the first rotatable member and second rotatable member or for both of the first rotatable member and the second rotatable member.

More specifically, one of the first rotatable member and the second rotatable member is a heating roller in a heat roller fixing device, and the other is a pressing roller. The heating roller is heated internally or externally by a heating source such as a halogen heater, an infrared radiation, a lamp, an electromagnetic induction coil, electric power supply heat generating element. The pressing roller may be heated. In a pressure fixing device, the first rotatable member and the second rotatable member are pressure fixing rollers constituting a pair.

2) The fixing device in the present invention includes a device for fixing or for temporarily fixing an unfixed toner image (visualized image, developer image) into a fixed image by heating and/or pressing, and a device for changing a surface property of the fixed toner image by re-heating it in the gloss or the like.

3) The image forming station of image forming apparatus is not limited to that of the electrophotographic type. It may be an electrostatic recording type, a magnetic recording system or the like. In addition, the image forming station is not limited to the transfer type, and it may be a directly transfer type in which the toner image this directory transferred onto the recording material.

4) the fixing device 40 may be used for an image forming apparatus other than the above-described electrophotographic printer, that is, for example, may be used for a color copying machine, a facsimile machine, a color printer or a complex machine thereof, and so on. The fixing device and the electrophotographic printer are not limited to the above-described examples, but may be partly modified with a substitute.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 145951/2013 filed Jul. 12, 2013, which is hereby incorporated by reference.

What is claimed is:

1. A roller usable as a rotatable member of a pair of rotatable members constituting a nip therebetween for heating an image on a sheet, said roller comprising:

a hollow cylindrical member;

a shaft member inserted into one longitudinal end of said cylindrical member;

a hole portion penetrating said cylindrical member and said shaft member;

a first countersink formed at a circumference of one end of said hole portion in an outerside of said cylindrical member;

a second countersink formed at a circumference of the other end of said hole portion in an outerside of said cylindrical member; and a pin inserted in said hole portion to fix said cylindrical member and said shaft member relative to each other, wherein one and the other end portions of said pin are deformed so as to be closely contacted to said first and second countersink portions, respectively, wherein said hole portion is provided within a range of the nip portion with respect to the longitudinal direction.

2. A roller according to claim 1, wherein said first countersink and said second countersink are formed into a conical shape.

3. A roller according to claim 1, wherein said pin has a hardness lower than that of said cylindrical member and that of said shaft member.

4. A roller according to claim 1, wherein said shaft member provides a shaft portion of said roller.

5. A roller according to claim 1, further comprising an elastic layer provided on an outer peripheral surface of said cylindrical member, and a toner parting layer provided on said elastic layer.

6. A roller according to claim 1, wherein said roller is contactable to a side of a sheet which is opposite a side carrying an unfixed toner image.

7. A manufacturing method for a roller usable as a rotatable member of a pair of rotatable members constituting a nip therebetween for heating an image on a sheet, said method comprising steps of:

inserting a shaft member into a one longitudinal end of a hollow cylindrical member;

forming a hole portion penetrating said cylindrical member and said shaft member;

forming a first countersink at a circumference of one end of said hole portion in an outerside of said cylindrical member;

forming a second countersink at a circumference of the other end of said hole portion in an outerside of said cylindrical member;

inserting a pin into said hole portion; and deforming opposite end portions of said pin so as to closely contact to said first and second countersink portions, respectively, wherein said hole portion is provided within the range of the nip portion with respect to the longitudinal direction.

8. A method according to claim 7, wherein said first countersink and said second countersink are formed into a conical shape.

9. A method according to claim 7, further comprising a step of providing a rubber layer is provided on an outer peripheral surface of said cylindrical member, after said deformation step.

10. A method according to claim 7, further comprising a step of providing an elastic layer on an outer peripheral surface of said cylindrical member to cover opposite end portions of said pin after said deforming step.

11. A method according to claim 7, further comprising a step of providing a toner parting layer on said elastic layer after said deforming step.

12. A fixing device comprising:

a rotatable member and a roller constituting a nip for heating an image on a sheet, said roller including, a hollow cylindrical member, a shaft member inserted into one longitudinal end of said cylindrical member, a hole portion penetrating said cylindrical member and said shaft member, a first countersink formed at a circumference of one end of said hole portion in an outerside of said cylindrical member, a second countersink formed at a circumference of the other end of said hole portion in an outerside of said cylindrical member, and a pin inserted in said hole portion to fix said cylindrical member and said shaft member relative to each other, wherein one and the other end portions of said pin are deformed so as to be closely contacted to said first and second countersink portions, respectively, and wherein said hole portion is provided within the range of the nip portion with respect to the longitudinal direction.

13. A device according to claim 12, wherein said first countersink and said second countersink are formed into a conical shape.

14. A device according to claim 12, wherein said pin has a hardness lower than that of said cylindrical member and that of said shaft member.

15. A device according to claim 12, wherein said shaft member provides a shaft portion of said roller.

16. A device according to claim 12, wherein said roller further includes an elastic layer on an outer peripheral surface of said cylindrical member to cover opposite end portions of said pin, and a toner parting layer on said elastic layer.

17. A device according to claim 12, wherein said roller is contactable to a side of a sheet which is a side carrying an unfixed toner image.

18. A device according to claim 12, wherein said roller is contactable to a side of a sheet which is opposite a side carrying an unfixed toner image.

* * * * *